US009818253B2

(12) United States Patent
Jones

(10) Patent No.: US 9,818,253 B2
(45) Date of Patent: Nov. 14, 2017

(54) CASINO STYLE GAME OF CHANCE APPARATUS

(71) Applicant: Mark Hamilton Jones and Sheryl Lynn Jones Family Trust dated Nov. 7, 2013, Gardnerville, NV (US)

(72) Inventor: Mark H. Jones, Gardnerville, NV (US)

(73) Assignee: Mark Hamilton Jones and Sheryle Lynn Jones Family Trust dated Nov. 7, 2013, Gardnerville, NV (US)

( * ) Notice: Subject to any disclaimer, the term of this patent is extended or adjusted under 35 U.S.C. 154(b) by 0 days.

(21) Appl. No.: 14/803,579

(22) Filed: Jul. 20, 2015

(65) Prior Publication Data

US 2016/0016074 A1 Jan. 21, 2016

Related U.S. Application Data

(60) Provisional application No. 62/026,472, filed on Jul. 18, 2014.

(51) Int. Cl.

| | |
|---|---|
| ***A63F 7/04*** | (2006.01) |
| ***G07F 17/32*** | (2006.01) |
| ***A63F 3/00*** | (2006.01) |
| *A63F 5/00* | (2006.01) |

(52) U.S. Cl.
CPC ..... *G07F 17/32* (2013.01); *A63F 3/00157* (2013.01); *A63F 5/00* (2013.01)

(58) Field of Classification Search
CPC ..... G07F 17/32; A63F 3/00157; A63F 5/00
USPC ..... 273/144 A, 144 B, 144 R; 463/16, 17
See application file for complete search history.

(56) References Cited

U.S. PATENT DOCUMENTS

| | | | | | |
|---|---|---|---|---|---|
| 2,315,323 | A | * | 3/1943 | Fostos | G07C 15/001 273/144 A |
| 2,385,980 | A | * | 10/1945 | Fostos | A63F 7/00 273/144 A |
| 4,185,828 | A | * | 1/1980 | Fernandez | A63F 3/062 273/142 J |
| 4,508,346 | A | * | 4/1985 | Salvucci | G07C 15/001 273/144 B |
| 5,088,737 | A | * | 2/1992 | Frank | A63F 7/048 273/139 |

(Continued)

*Primary Examiner* — Vishu Mendiratta
(74) *Attorney, Agent, or Firm* — John S. Artz; Dickinson Wright PLLC

(57) ABSTRACT

A random number generator for a game of chance capable of selecting at least two numbers which are relevant to an outcome of the game of chance, includes a blower, a first mixing chamber housing a first set of balls bearing indicia in accordance with rules of the game of chance and a second mixing chamber housing a second set of balls bearing indicia in accordance with rules of the game of chance. The first mixing chamber is in communication with a first selector including a first calling chamber. The second mixing chamber is in communication with a second selector including a second calling chamber. A first valve has a closed position and an open position. In the open position of the first valve, the first selected ball is allowed to pass from the first mixing chamber to the first calling chamber. A second valve has a closed position and an open position. In the closed position of the second valve, the second selected ball is allowed to pass from the second mixing chamber to the second calling chamber.

22 Claims, 7 Drawing Sheets

(56) References Cited

U.S. PATENT DOCUMENTS

| | | | | | |
|---|---|---|---|---|---|
| 5,121,920 | A * | 6/1992 | Laezzo | G07C 15/001 | 273/144 A |
| 5,380,007 | A * | 1/1995 | Travis | A63F 7/048 | 273/144 B |
| 5,566,940 | A * | 10/1996 | Powell | A63F 7/048 | 273/144 A |
| 6,168,155 | B1 * | 1/2001 | Kuhlman | G07C 15/00 | 273/138.2 |
| 8,113,516 | B2 * | 2/2012 | Jones | A63F 3/00157 | 273/138.1 |
| 8,128,089 | B2 * | 3/2012 | Erickson | A63F 3/062 | 273/138.2 |
| 2002/0082072 | A1 * | 6/2002 | Seelig | A63F 7/048 | 463/17 |
| 2004/0204225 | A1 * | 10/2004 | Campo | G07F 17/32 | 463/19 |

* cited by examiner

CASINO STYLE GAME OF CHANCE APPARATUS

CROSS-REFERENCE TO RELATED APPLICATIONS

The present application claims priority to U.S. Provisional Patent Application Ser. No. 62/026,472 entitled "Casino Style Game of Chance Apparatus", filed Jul. 18, 2014, the disclosure of which is hereby incorporated by reference, as though set forth fully herein.

TECHNICAL FIELD

The present disclosure relates generally to a game of chance and more particularly to a casino game apparatus for a game of chance that generates multiple random numbers independently without the use of dice.

BACKGROUND OF THE DISCLOSURE

Games of chance have been played throughout all of human history, and are considered popular pastimes by many. Indeed, casino games such as craps, roulette, poker and blackjack have become very popular over the last half century. In addition to being popular with players, they are profitable for casinos. Part of the allure of most games of chance is that they allow players to wager money on their outcomes. However, as is known, games of chance that permit money wagering are generally regulated by governing authorities or outlawed altogether. Indeed, there are only a limited number of places where people interested in placing wagers on such games can go to do so because these wagering games are not allowed in most states.

Most games of chance utilize a randomizing device to determining an outcome, which are known to include dice, spinning tops, playing cards, roulette wheels, prize wheels, and/or numbered balls drawn from containers. The governing authorities that regulate game play also enforce laws and regulations that have curtailed certain kinds of games as well as certain kinds of randomizing devices. For example, in some jurisdictions, the use of dice or roulette wheels to resolve a game outcome, i.e., as the randomizing device, have been curtailed. By way of example, the use of dice has been curtailed as many players have come to distrust "loaded dice", which refers to their propensity to favor particular results when rolled. Whether or not loaded dice are being used in a game of chance at casinos, the fact that they have in the past gives players lingering doubts that they might be, which renders their use as a randomizing device suspect. This is only enhanced by the fact that the odds of games of chance always favor the casino.

Casinos have thus become desirable of new, more reliable randomizing devices. Similarly, players of games of chance have become attracted to methods of game play that utilize new and exciting randomizing devices and which are perceived to be fairer and provide improved odds. For this reason, the gaming industry is continuously developing new games and new randomizing devices to maintain player interest and attract new players.

SUMMARY OF THE DISCLOSURE

It is therefore an aspect of the present disclosure to provide a casino game of chance that utilizes a random number generator that can generate multiple numbers independently.

It is another aspect of the present disclosure to provide a casino game of chance that utilizes a random number generator that can be utilized with games that have traditionally employed dice.

It is a further aspect of the present disclosure to provide a casino game of chance that includes a random number generator that is more accurate and fair.

It is yet another aspect of the present disclosure to provide a casino game of chance that can yield more player excitement.

In accordance with the above and the other aspects of the present disclosure, a random number generator for a game of chance is provided. The random number generator includes a blower, a first mixing chamber in communication with the blower, and a second mixing chamber in communication with the blower. The first mixing chamber is configured to hold a first plurality of balls bearing indicia relevant to determining an outcome of the game of chance. The second mixing chamber is configured to hold a second plurality of balls bearing indicia relevant to determining the outcome of the game of chance. The first mixing chamber includes a generally upwardly extending first selector disposed in an upper portion thereof. The first selector has an open bottom to allow a first selected ball from the first plurality of balls to enter the first selector and a first calling chamber disposed adjacent an upper end of the first calling chamber for displaying the first selected ball. The second mixing chamber includes a generally upwardly extending second selector disposed in an upper portion thereof. The second selector has an open bottom to allow a second selected ball from the second plurality of balls to enter the second selector and a second calling chamber disposed adjacent an upper end of the second calling chamber for displaying the second selected ball. The random number generator includes a first valve and a second valve. The first valve has an open position that allows one of the first plurality of balls to enter the first calling chamber and a closed position that prevents one of the first plurality of balls from entering the first calling chamber. The second valve has an open position that allows one of the second plurality of balls to enter the second calling chamber and a closed position that prevents one of the second plurality of balls from entering the second calling chamber.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION OF THE INVENTION

According to an aspect, the present disclosure relates to a game of chance and a method of playing same that utilizes a more reliable and unique random number generator. By way of example, the disclosed random number generator may be utilized in connection with a game of chance that traditionally utilizes dice such as are employed with the game of craps. However, the disclosed random number generator may be utilized in connection with a variety of different games of chance in place of or to supplement a variety of other known random number generators to assist in determining an outcome.

Figure 1:
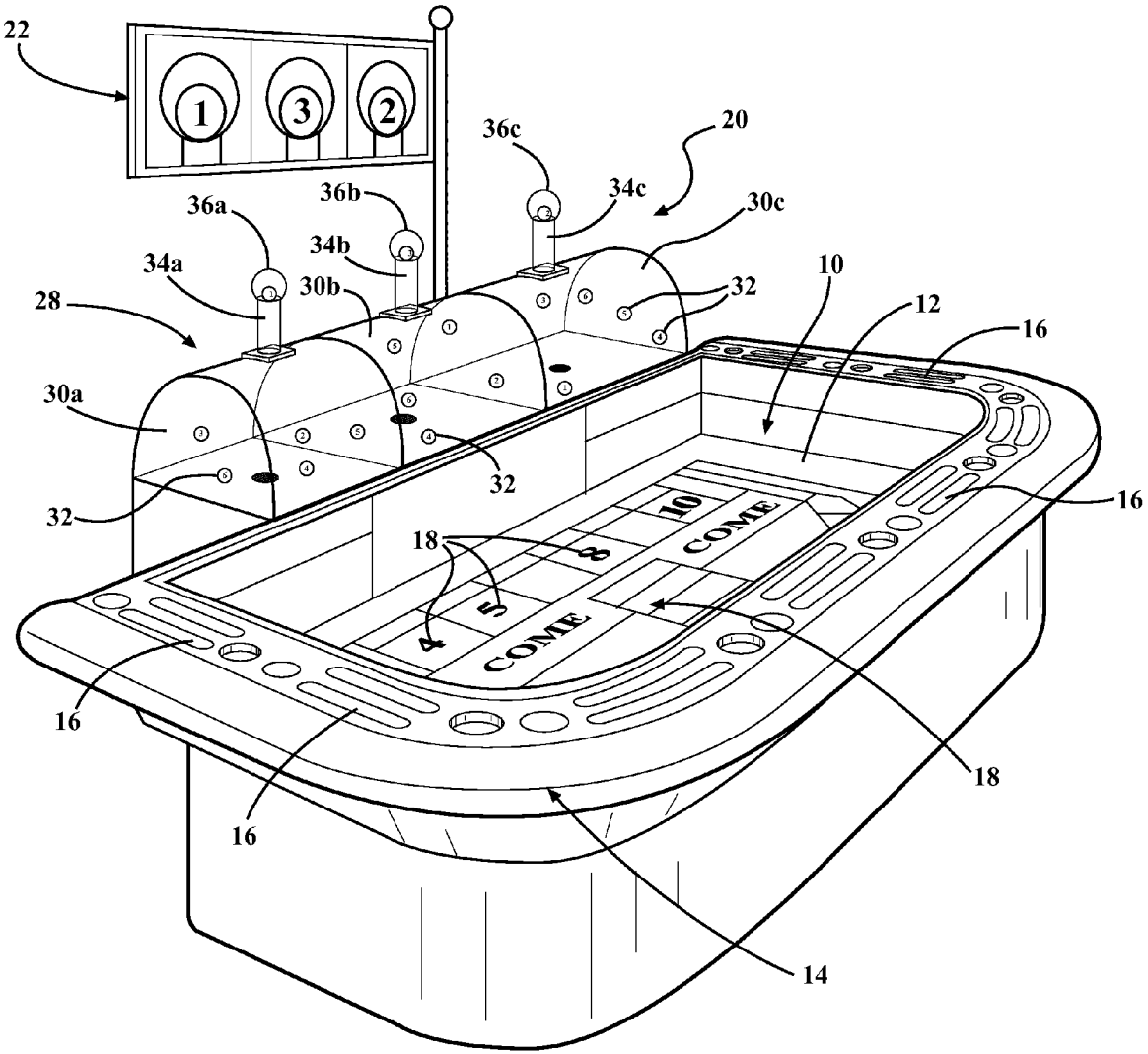
FIG. 1 is a perspective view of a table game system employing a random number generator in accordance with an aspect of the present disclosure.

According to an aspect and with reference to FIG. 1, the disclosed game of chance 10 can include a game playing surface 12 that is configured to have indicia thereon relevant to the rules or criteria of the game of chance being played. The game playing surface 12 may be disposed on a table 14; however, it may also be disposed on a variety of other suitable places. According to another aspect, the game surface 12 can include indicia representing a plurality of player locations where individual players may reside and play the game, as generally represented by reference number 16. The game surface 12 may also have indicia thereon representing a variety of different wagering areas, as generally indicated by reference number 18. The number, value and location of the wagering areas may vary and can correspond to the rules of the game being played. Similarly, the number and placement of the player locations may also vary.

According to a further aspect, a random number generator 20 may be disposed on or adjacent the table 14. The disclosed random number generator 20 may be configured to select multiple random numbers independently, the selected numbers being determinative of the game's winning indicia and thus its outcome. The game 10 may also include one or more displays 22 associated with the game surface 12 for displaying the selected numbers. According to an aspect, the one or more displays may be clearly viewable by all the players at the table as well as observers of the game. The one or more displays 22 may be a conventional LCD screen; however, a variety of other suitable display screens may also be employed. It will also be appreciated that instead of or in addition to the player locations 16 on the game surface 12, one or more electronic player terminals may be available for use by players to place their wagers electronically and monitor the game electronically, including the placement and resolution of wagers. It will further be appreciated that the game can include a computer, processor and/or other associated hardware and software that allow the entirety of the game to be played on a computer electronically, including the placement and resolution of any wagers automatically. The player terminals (not shown) may be located adjacent the table 14 or may be disposed remotely.

Figure 2:
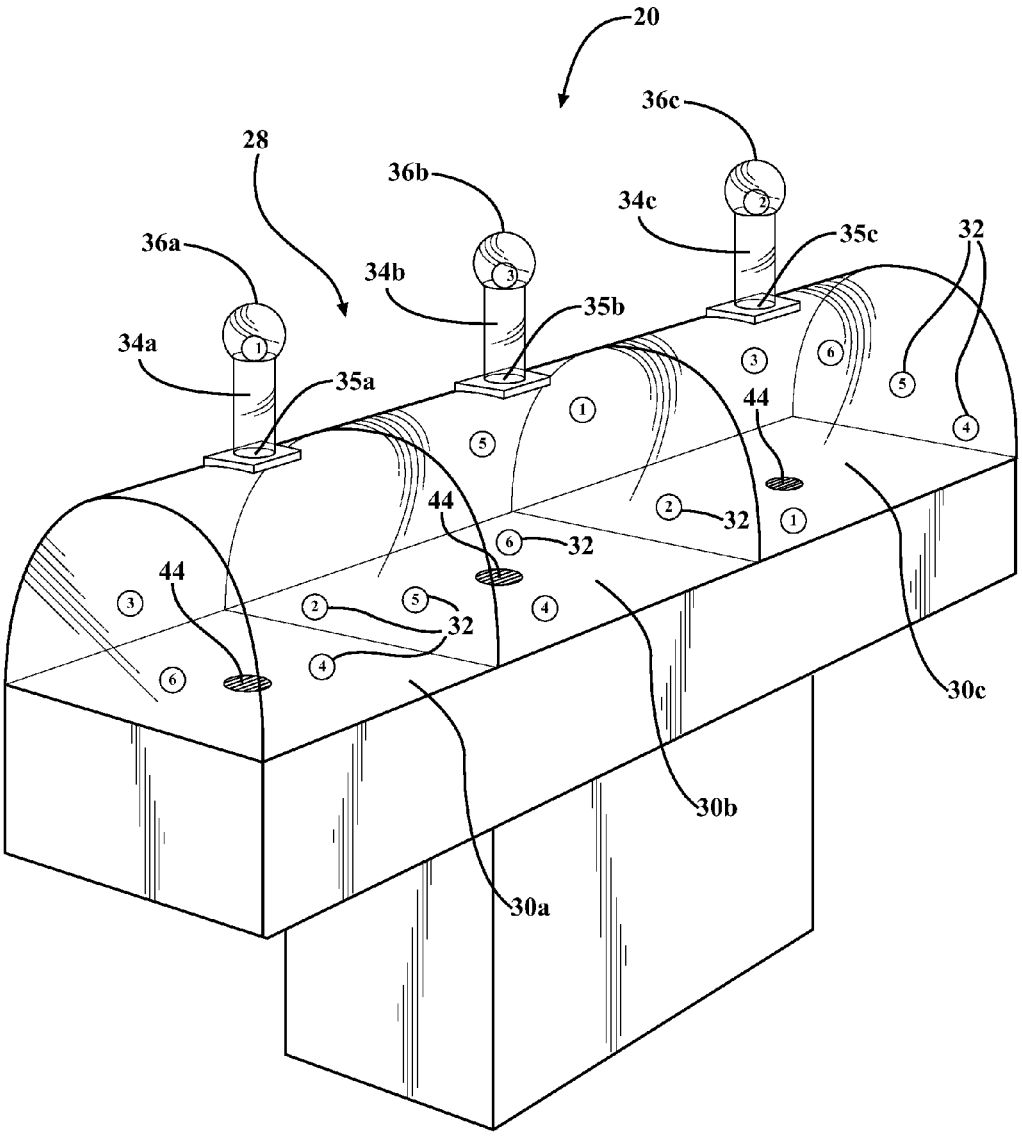
FIG. 2 is a perspective view of a random number generator in accordance with an aspect of the present disclosure.
Figure 3:
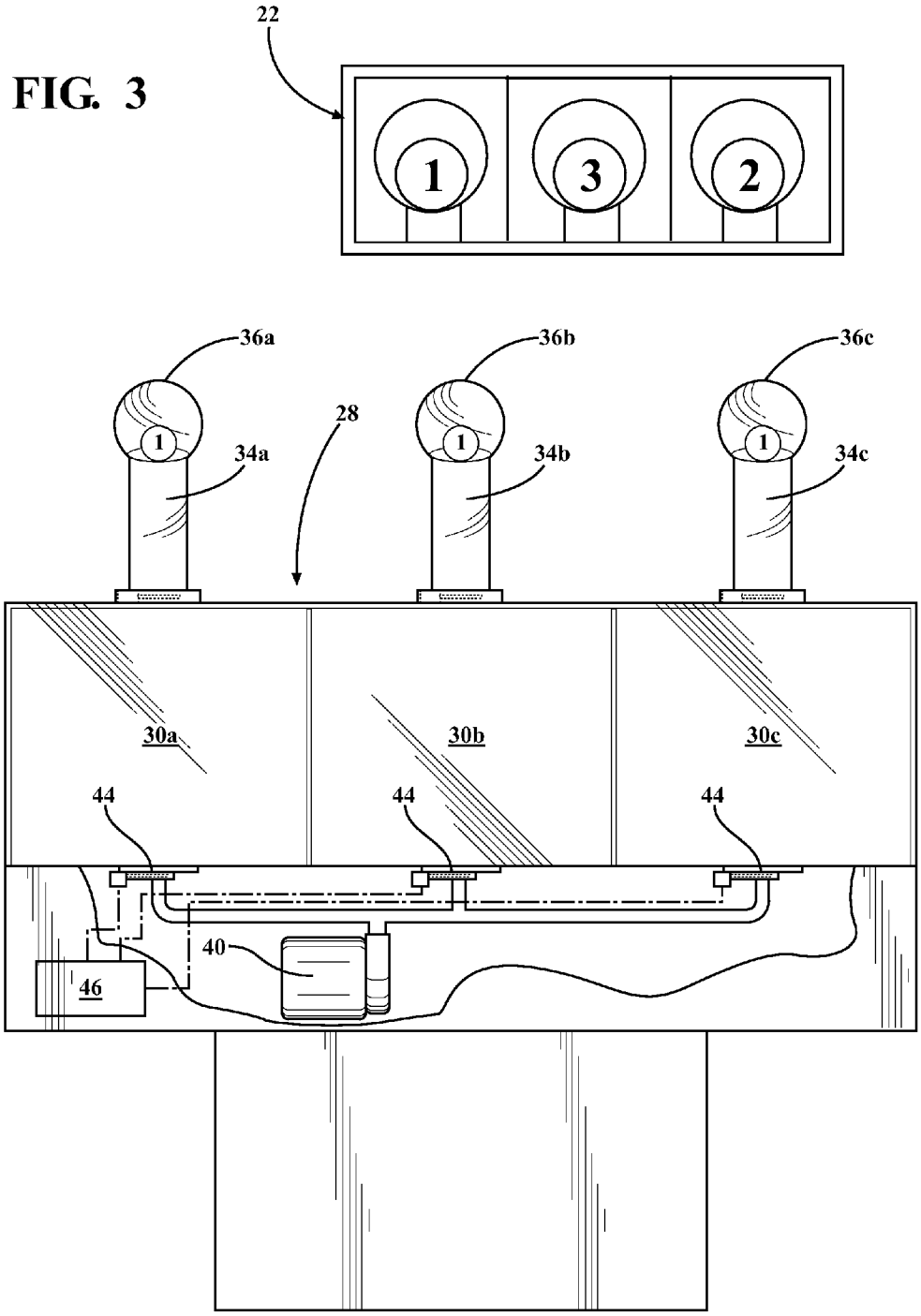
FIG. 3 is a side view of a random number generator in accordance with an aspect of the present disclosure.

According to an aspect and with reference to FIGS. 2 and 3, the number selector or random number generator 20 can include a chamber housing 28 having a plurality of mixing chambers 30*a*, 30*b*, 30*c* each being configured to hold a group of balls. According to another aspect, each mixing chamber 30*a*, 30*b*, 30*c* may be in communication with a respective ball selector 34*a*, 34*b*, 34*c* for displaying a ball that is received from each of the associated chambers 30*a*, 30*b*, 30*c*. According to an aspect, each of the selectors 34*a*, 34*b*, 34*c* can extend outwardly and upwardly from their respective chamber 30*a*, 30*b*, 30*c* such that a ball can be received therein. Each selector 34*a*, 34*b*, 34*c* can include a lower or inlet end 35*a*, 35*b*, 35*c* and a display unit or calling chamber 36*a*, 36*b*, 36*c* disposed adjacent an upper end thereof into which the selected ball may pass and be seen. It will be appreciated that the ball selectors can have a variety of different configurations and can extend in a variety of different directions. For example, the ball selectors may be transparent. It will also be appreciated that each mixing chamber 30*a*, 30*b*, 30*c* can include a set of balls 32 disposed therein with each ball including indicia marked or printed therein that is relevant to an outcome of the game of chance. For example, the balls 32 in each of the mixing chambers could be marked with indicia corresponding to the numbers 1 through 6 as are the possible outcomes if a single die was thrown.

According to an aspect, the number of ball selectors 34*a*, 34*b*, 34*c* can vary depending upon the number of outcomes necessary to play the game. For example, if the game of chance to be played is craps, two ball selectors 34*a*, 34*b* could be employed. Each ball selector 34*a*, 34*b* could be configured to independently receive a ball 32 from a respective mixing chamber 30*a*, 30*b*. According to this aspect, each mixing chamber 30*a*, 30*b*, 30*c* could include a set of balls numbered 1 through 6.

According to another exemplary aspect, the number of chambers 30*a*, 30*b*, 30*c* and the number of ball selectors 34*a*, 34*b*, 34*c* may be numbered according to the rules of the game Sic Bo, which typically employs three dice to generate the winning combination numbers. According to this aspect, the chambers 30*a*, 30*b*, 30*c* could each include an individual set of balls numbered 1 through 6. It will also be appreciated that the random number generator 20 of the present disclosure may be employed with a variety of other suitable games, including blackjack and bingo. It will also be appreciated that any number of balls and/or ball selectors may be employed. For a game of blackjack, multiple ball selectors could be employed. It will also be appreciated that instead of multiple chambers, a single chamber could be employed which houses multiples sets of balls 32 therein.

According to a still further aspect, the random number generator 20 could be employed to effectuate casino drawings based on assigned player card number. According to this aspect, multiple mixing chambers and ball selectors corresponding to the number of player cards issued could be employed. Each mixing chamber could include ten balls numbers 0 to 9. According to another aspect, as the highest player card number changes, additional mixing chambers and ball selectors could be added to accommodate the number of players. Additionally, additional balls could be employed such that the highest number could be drawn from the combined units.

According to an aspect, a blower unit 40 may be disposed adjacent the chamber housing 28 and configured to communicate with each of the mixing chambers 30*a*, 30*b*, 30*c* to agitate and mix the balls in each of the mixing chambers. The blower unit 40 may be actuated to start the game. It will be appreciated that the blower unit 40 may be in communication with a control system for the game such that once a switch for the game is actuated, the blower unit may start as dictated by the sequence of the game. Alternatively, the blower unit 40 may be actuated manually.

According to another aspect, the blower unit 40 may be individually and selectively placed into communication with each of mixing chambers 30*a*, 30*b*, 30*c* by a respective blower conduit 42*a*, 42*b*, 42*c*. According to a still further aspect, one or more diaphragm valves 44 may be located in the inlets of each of the conduits 42*a*, 42*b*, 42*c* in order to regulate the flow of air from the blower unit 40 into the appropriate mixing chamber 30*a*, 30*b*, 30*c*. According to an aspect, the diaphragm valves 44 may be in communication with the control system 46 such that they may be actuated automatically in accordance with a predetermined sequence for game operation. The use of one or more diaphragms valves 44 to allow the blower 40 to provide air into only one mixing chamber at a time permits the individual and independent selection of multiple balls with only a single blower source. It will be appreciated that a plurality of blowers may also be employed. It will also be appreciated that a variety of different types of valves may be employed.

According to another aspect, the diaphragm valves 44 may also be disposed at the inlet end of each the selectors 34*a*, 34*b*, 34*c* to selectively block their passage. This ensures that only a single ball is passed from a mixing chamber to its respective ball selector. Again, the diaphragm valves may each be in communication with the control system 46 to occur automatically such as based on sensor input that a ball has passed the valve or they may operate manually. It will be appreciated that valves could be located in both places. It will also be appreciated that instead of diaphragm valves, other suitable types of valves may be employed.

According to a further aspect, the game may additionally include one or more cameras affixed to a structure proximate the ball selectors 34*a*, 34*b*, 34*c* for viewing the indicia on the selected balls contained therein. The one or more cameras may be in communication with the displays 22 such that the indicia of the singulated balls may be projected onto the display 22 for viewing by participants and observers of the game. According to a still further aspect of the disclosure, each of the balls 32 could include a readable device that could be automatically read as the ball enters the ball selectors. For example, the balls could each include an RFID tag that could be read as the ball enters a respective ball selector 34*a*, 34*b*, 34*c*, such as by an RFID reader associated therewith. The information stored on the RFID tag could correspond to the indicia of the ball. According to an aspect, the information read by the reader could then be passed to the computer system for projection onto the one or more displays. It will be appreciated that the readable devices could be located in a variety of other locations, including adjacent an upper portion of each of the ball selectors.

To play the game of this disclosure without the use of dice, several mechanism can be used to generate a decision. One way to generate a decision may be by using a pair of ball blowers, commonly used in bingo, each blower having balls numbered from one to six. The sum of the combination of the two numbered balls selected by the ball selectors would constitute a decision and the play of the game would continue based on this decision and the rules of the game. According to an aspect, each number selected by a ball selector may be relevant to the outcome of the game of chance. According to another aspect, the numbers selected from the various ball selectors may be combined or summed to arrive at the outcome of the game of chance.

According to an aspect, the ball selectors and blowers may be of a type commonly used in bingo games where one of a set of light-weight, numbered, plastic balls can be randomly selected. The balls may be kept in movement inside the mixing chamber and, when the blower is activated, one ball nearest the entrance of the ball selector is allowed to enter the chute where it is blown to the top thereof. In the top of the ball selector, the selected ball can be viewed by the dealer and players and can also be viewed by a video camera.

According to an aspect, the game may be played by players at various player locations 16 making bets or wagers on the game playing surface 12 such as by placing chips in one or more wagering areas 18. Since dice are not used in the game, the layout does not contain any indicia of dice. For example, to show the odds for various combinations of numbers resulting from a random number decision generation, the numbers could be shown in circles to represent the balls, rather than by showing dots in squares to represent the face of dice. Also, since dice are not used in the game, there is no need to have the inside vertical wall covered by a diamond rubber surface commonly used in conventional tables where dice are thrown.

According to an aspect, the mixing chambers 30*a*, 30*b*, 30*c* can each contain six balls with each ball marked with a separate, distinct number from one to six, inclusive or whatever indicia is relevant to an outcome of the game of chance being played. After the players have placed their bets, the dealer can start the ball blower 40 causing the balls in the first mixing chamber 30*a* to be continually stirred and agitated. Before the ball blower 40 is started, the diaphragm valve 44 may be positioned such that air is directed into the first mixing chamber 30*a* and blocked off from any additional chambers. After the balls have been allowed to be stirred, the dealer can push a "select" button on his control unit (not shown) which will open access for the balls to the bottom of the ball selector 34*a*, which is associated with the first mixing chamber 30*a*. The blower 40 forcing air up the ball selector 34*a* can cause the next ball that passes the opening to the bottom of the ball selector to be forced up its chute where it can be observed in the top of the ball selector 34*a* by a video camera or the like. Alternatively, the indicia of the ball may be read by reader as the ball enters or passes through the ball selector 34*b*. Either way, the ball's indicia, as viewed by the camera or read by the reader can be displayed on the screen of a display monitor 22.

According to an aspect, the diaphragm valve 44 may then be moved to close air off to the mixing chamber 30*a* and allow air to flow into the mixing chamber 30*b*. The same steps above may be repeated until a ball is received in the ball selector 34*b* and added to the display monitor 22. The same sequence can then apply for the selection of a ball by additional ball selectors. After all the necessary balls have been selected, the dealer may resolve all wagers placed on the game playing surface 12. Thereafter, the blower 40 may be turned off and the balls allowed to return to their respective mixing chamber for the next game.

FIGS. 4 through 7 illustrate an individual blower assembly 50 in accordance with another aspect of the present disclosure. The individual blower assembly 50 can be incorporated into a random number generator 10 such that multiple balls can be utilized to determine an outcome of a game of chance. According to an aspect, the blower assembly 50 can include a housing 51 with a mixing chamber 52 that includes a plurality of balls 54 that are relevant to determine a game outcome. According to a further aspect, the housing 51 may have a generally cylindrical shape. According to a further aspect, the housing 51 may be generally transparent such that the plurality of balls 54 can be seen during the mixing process. The mixing chamber 52 can include an air inlet 56 disposed at a bottom thereof. The air inlet 56 may be in communication with a blower or other source of air in order to effectuate agitation of the multiple balls.

According to a further aspect, the blower assembly 50 can include a ball selector 58 having a lower portion 60 and an upper portion 62 or calling chamber. As shown, the ball selector 58 may extend into the mixing chamber 52 such that it extends vertically upward from an upper surface of the mixing chamber 52. It will be appreciated that the mixing chamber 52 and the ball selector 58 can have a variety of different configurations. It will also be appreciated that each of the multiple balls can bear indicia relevant to determining an outcome of the game of chance and the number of balls can vary depending upon the game of chance being played.

Figure 4:
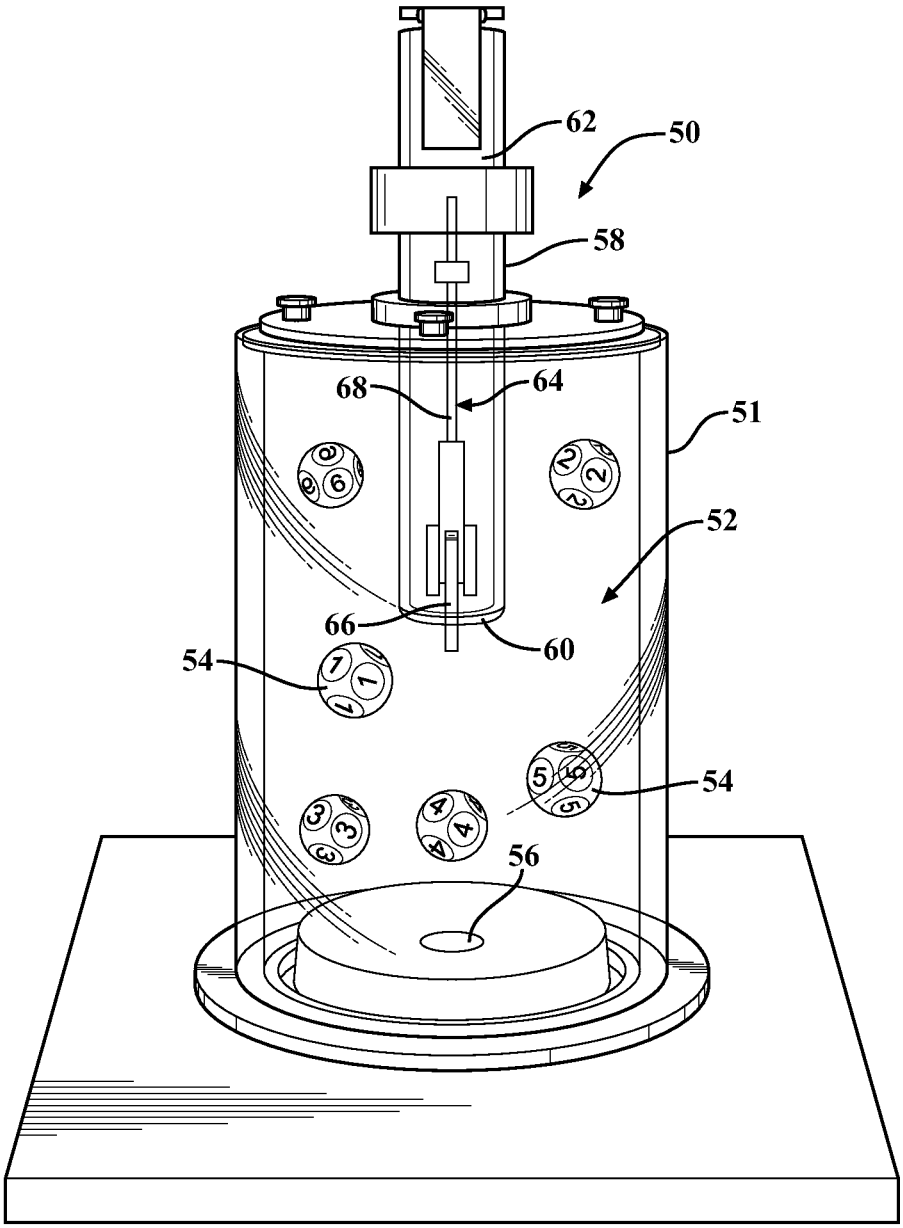
FIG. 4 is a perspective view of a blower for a random number generator in accordance with another aspect of the present disclosure.
Figure 5:
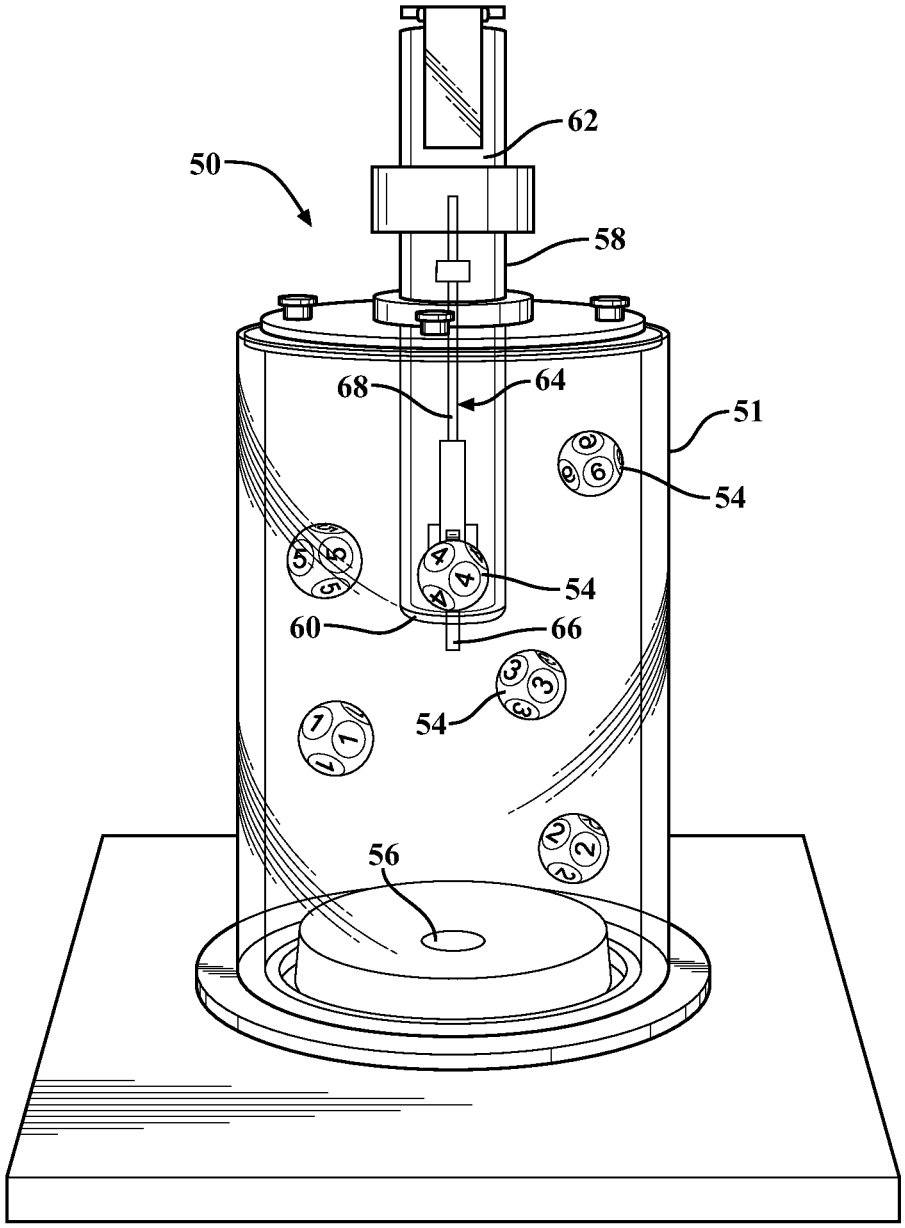
FIG. 5 is a perspective view of a blower for a random number generator with a ball in a ball selector and a valve in a closed position in accordance with another aspect of the present disclosure.

According to a further aspect, a valve mechanism 64 can be employed within the ball selector 58. The valve mechanism 64 can include a seat portion 66 and a stem portion 68. As shown, the lower portion 60 of the ball selector 58 may be open such that one of the balls may enter the ball selector during agitation of the balls in the mixing chamber 52. According to an aspect as shown in FIGS. 4 and 5, the valve mechanism 64 has a closed position that prevents the ball from traveling to the calling chamber 62 of the ball selector. As shown in FIG. 5, a ball 54 may enter the lower portion 60 of the ball selector 58, but is prevented from entering the calling chamber 62 as the valve mechanism 64 is in the closed position.

Figure 6:
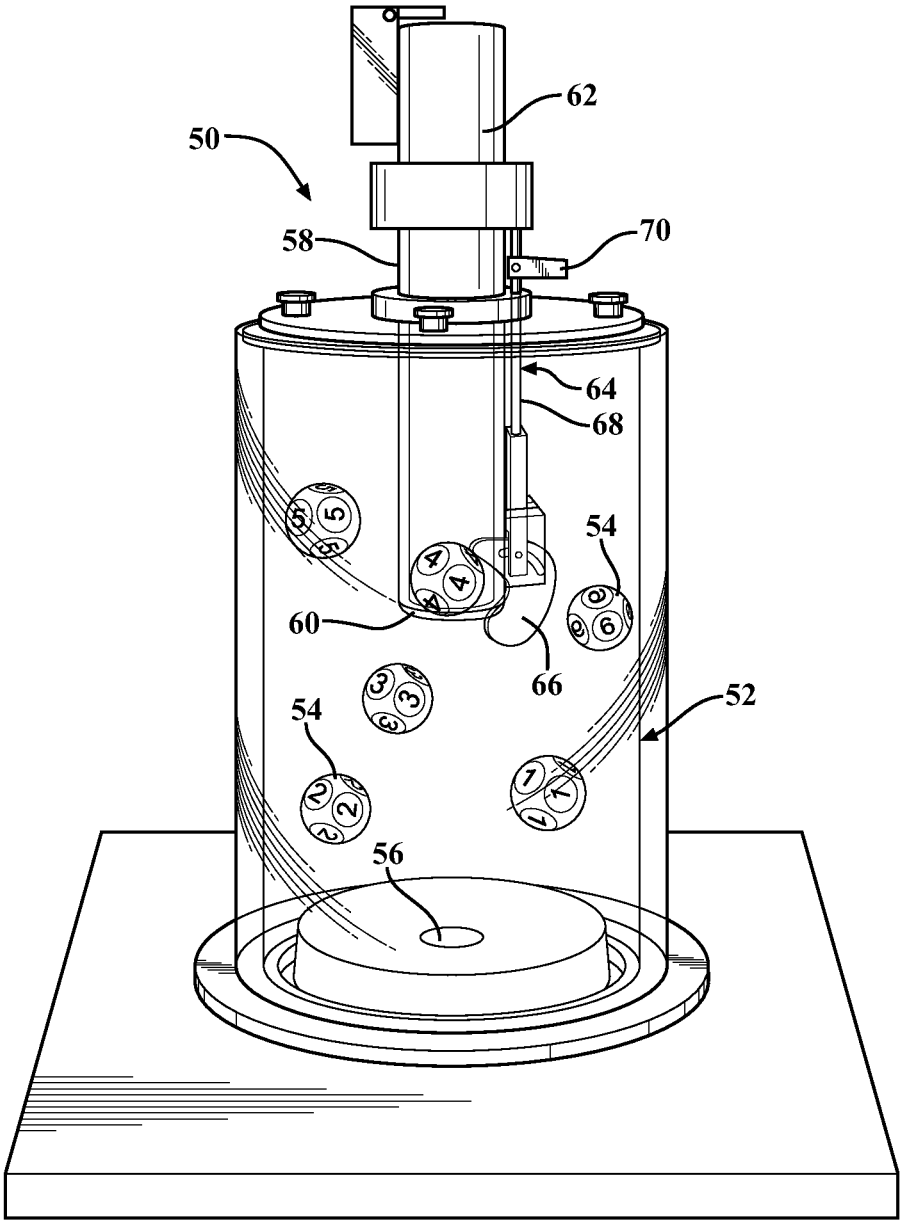
FIG. 6 is a perspective view of a blower for a random number generator with a ball in a ball selector and a valve in an open position in accordance with another aspect of the disclosure.
Figure 7:
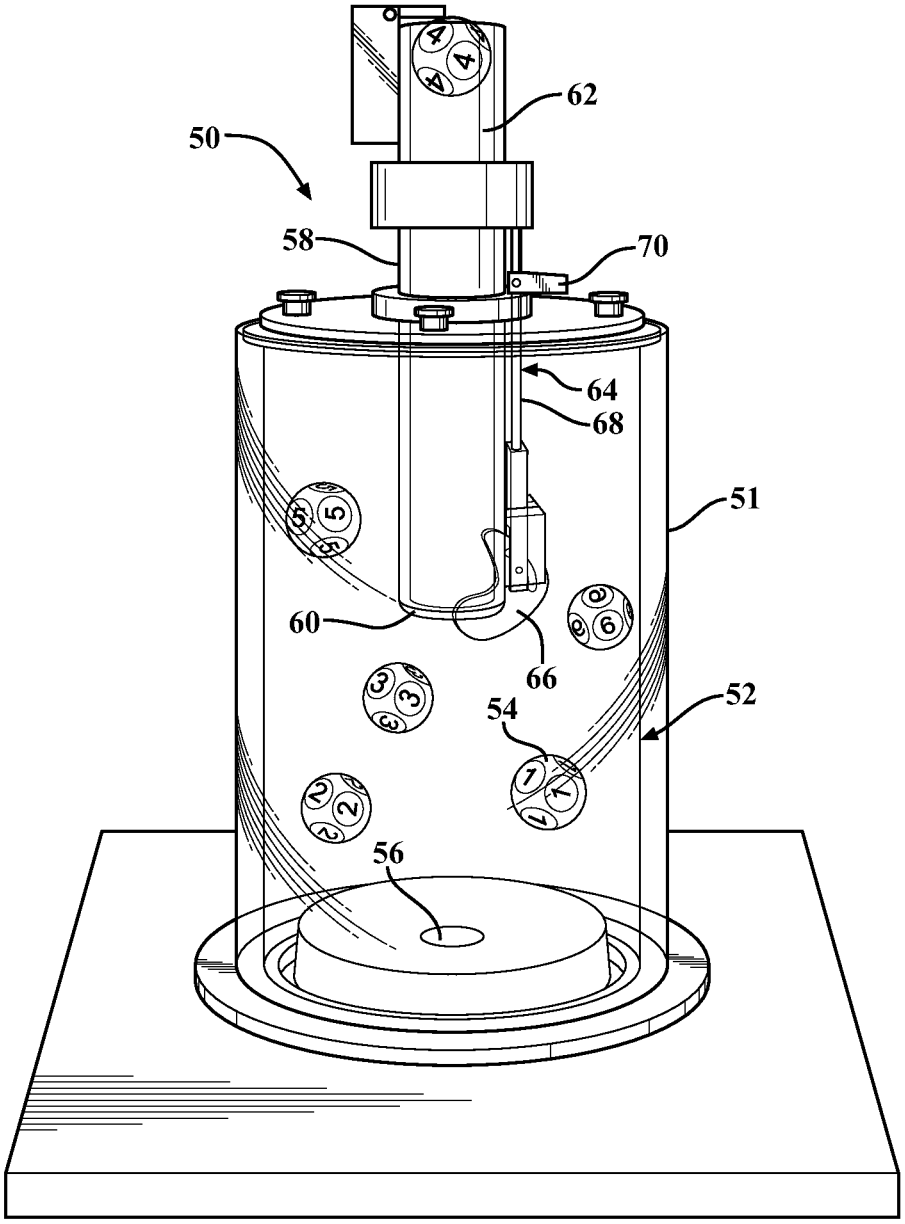
FIG. 7 is a perspective view of a blower for a random number generator with a ball in a calling unit in accordance with another aspect of the present invention.

According to a further aspect and as shown in FIG. 6, the valve mechanism 64 can include an actuator 70 that can be manually actuated to move the valve mechanism 64 to the open positions such that the seat portion 66 allows the selected ball to pass to the calling chamber 62. It will be appreciated that the valve mechanism 64 can take on a variety of different configurations. It will also be appreciated that the valve mechanism can be connected to a control system such that it may be actuated electronically.

Note that not all of the activities described above in the general description or the examples are required, that a portion of a specific activity may not be required, and that one or more further activities may be performed in addition to those described. Still further, the orders in which activities are listed are not necessarily the order in which they are performed.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Many other embodiments may be apparent to those of skill in the art upon reviewing the disclosure. Other embodiments may be used and derived from the disclosure, such that a structural substitution, logical substitution, or another change may be made without departing from the scope of the disclosure. Accordingly, the disclosure is to be regarded as illustrative rather than restrictive.

Certain features are, for clarity, described herein in the context of separate embodiments, may also be provided in combination in a single embodiment. Conversely, various features that are, for brevity, described in the context of a single embodiment, may also be provided separately or in any sub combination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The invention claimed is:

1. A game of chance capable of selecting at least two numbers which are relevant to an outcome of the game of chance, comprising:

a table surface having indicia relevant to the game of chance; and a random number generator adjacent to the table surface having, a single blower;

a first mixing chamber in communication with the single blower, the first mixing chamber being configured for holding a first plurality of balls bearing indicia relevant to determining an outcome of the game of chance;

a first selector disposed in an upper portion of the first mixing chamber and extending generally upwardly therefrom, the first selector having an open bottom to allow a first selected ball from the first plurality of balls to enter the first selector, with a first calling chamber disposed adjacent an upper end of the first selector for receiving and displaying the first selected ball;

a control system;

a first valve disposed within the bottom portion of the first mixing chamber and moveable between an open position and a closed position in response to instructions from the control system, wherein the first mixing chamber is fluidly connected with the single blower when the first valve is in the open position, and wherein the first mixing chamber and the single blower are fluidly disconnected when the first valve is in the closed position;

a second mixing chamber in communication with the single blower, the second mixing chamber being adjacent the first mixing chamber, the second mixing chamber being configured for holding a second plurality of balls bearing indicia relevant to determining the outcome of the game of chance;

a second selector disposed in an upper portion of the second mixing chamber and extending generally upwardly therefrom, the second selector having an open bottom to allow a second selected ball from the second plurality of balls to enter the second selector, with a second calling chamber disposed adjacent an upper end of the second selector for receiving and displaying the second selected ball;

a second valve disposed within the bottom portion of the second mixing chamber and moveable between an open position and a closed position in response to instructions from the control system, wherein the second mixing chamber is fluidly connected with the single blower when the second valve is in the open position, and wherein the second mixing chamber and the single blower are fluidly disconnected when the second valve is in the closed position; and wherein the single blower is configured to generate air to agitate the first plurality of balls in the first mixing chamber and the second plurality of balls in the second mixing chamber, wherein when the first valve is in the open position the single blower causes the first selected ball to enter the first calling chamber and when the first valve is in the closed position the first plurality of balls are prevented from entering the first calling chamber, and wherein when the second valve is in the open position the single blower causes the second selected ball to enter the second calling chamber and when the second valve is in the closed position the second plurality of balls are prevented from entering the second calling chamber.

2. The game of chance of claim 1, wherein the first and second mixing chambers are transparent.

3. The game of chance of claim 1, wherein the game of chance is selected from at least one of the following: craps, roulette, blackjack and Sic Bo.

4. The game of chance of claim 1, wherein the first valve and the second valve are actuatable independently.

5. The game of chance of claim 1, wherein the first valve is located adjacent the lower end of the first selector, wherein in the closed position, the first valve prevents any of the first group of balls from entering the first calling chamber and in the open position, the first valve allows the first selected ball to enter the first calling chamber; and wherein the second valve is located adjacent the lower end of the second selector, wherein in the closed position, the second valve prevents any of the second group of balls from entering the second calling chamber and in the open position, the second valve allows the second selected ball to enter the second calling chamber.

6. The game of chance of claim 1, wherein the first plurality of balls each include an electronic readable device including indicia information of each of the first plurality of balls; and wherein the second plurality of balls each include an electronic readable device including indicia information of each of the second plurality of balls stored thereon.

7. The game of chance of claim 6, wherein the electronic readable device for each of the first plurality of balls is an RFID chip and wherein the electronic readable device for each of the second plurality of balls is an RFID chip.

8. The game of chance of claim 1, wherein the outcome of the game of chance consists of a single number that equals the total of the first selected ball and the second selected ball.

9. The game of chance of claim 1, wherein the outcome of the game of chance consists of two numbers reflected individually by the first selected ball and the second selected ball.

10. The game of chance of claim 1, further comprising:

at least a third mixing chamber, a third selector and a third calling chamber in communication with the blower for selecting a third selected ball from a third group of balls to assist with determining the outcome of the game of chance.

11. The game of chance of claim 1, wherein the first and second valves are diaphragm valves.

12. The game of chance of claim 1 wherein the control system is configured to move the first valve into the open position and to move the second valve into the closed position at the same time that the first valve is in the open position.

13. A game of chance capable of selecting a plurality of numbers that are relevant to an outcome of the game of chance, comprising:

a table surface having indicia relevant to the game of chance; and a random number generator adjacent to the table surface having, a control system;

a chamber housing;

a plurality of mixing chambers disposed in the chamber housing, each of the mixing chambers including multiple balls bearing indicia relevant to the outcome of the game of chance;

the plurality of mixing chambers are each in communication with a separate ball selector, with each ball selector being configured to receive one selected ball from each of the plurality of mixing chambers;

a blower unit for agitating the multiple balls in each of the plurality of mixing chambers;

wherein the blower unit is configured to generate air for agitating the multiple balls in each of the plurality of mixing chambers; and wherein each of the plurality of mixing chambers includes a separate valve mechanism disposed adjacent an inlet portion of the ball selectors, with each of the valve mechanisms being moveable between an open position and a closed position in response to instructions from the control system, wherein the open position allows a selected ball to pass through the valve into a separate calling unit of each of the ball selectors and wherein the closed position prevents any of the multiple balls from passing through the valve and entering the calling units.

14. The game of chance of claim 13, wherein each of the plurality of mixing chambers are transparent.

15. The game of chance of claim 13, wherein the game of chance is selected from at least one of the following: craps, roulette, blackjack and Sic Bo.

16. The game of chance of claim 13, wherein the multiple balls in each of the mixing chamber include an electronic readable device including indicia information of each of the balls.

17. The game of chance of claim 16, wherein the electronic readable device for each of the multiple balls is an RFID chip.

18. The game of chance of claim 13, wherein the outcome of the game of chance consists of a single number that equals the total of the selected balls from each of the mixing chambers.

19. The game of chance of claim 13, wherein the outcome of the game of chance consists of a combination of the individual numbers selected from each of the mixing chambers.

20. The game of chance of claim 12 wherein the control system is further configured to move the second valve into the open position and to move the first valve into the closed position at the same time that the second valve is in the open position.

21. The game of chance of claim 13 wherein each of the valve mechanisms includes a stem portion and a seat portion being rotatably connected to the stem portion such that the seat portion is positioned to overly the inlet portion of the ball selector when the valve mechanism is in the closed position and to be spaced from the inlet portion of the ball selector when the valve mechanism is in the open position.

22. The game of chance of claim 13 wherein the plurality of mixing chambers are each in communication with a separate ball selector extending at least partially into the mixing chamber.

* * * * *